US005348404A

United States Patent [19]

Movaghar et al.

[11] Patent Number: 5,348,404

[45] Date of Patent: Sep. 20, 1994

[54] SPLIT BUSHING MOUNTING OF A PRINTER CARRIAGE WITH PRE-LOAD

[75] Inventors: Abdolreza Movaghar, San Diego; W. Wistar Rhoads, Escondido, both of Calif.; Michael A. Nguyen, Singapore, Singapore

[73] Assignee: Hewlett-Packard Company, Palo Alto, Calif.

[21] Appl. No.: 56,335

[22] Filed: Apr. 30, 1993

Related U.S. Application Data

[63] Continuation-in-part of Ser. No. 965,480, Oct. 23, 1992.

[51] Int. Cl.[5] ..... B41J 11/22

[52] U.S. Cl. ..... 400/354; 400/53

[58] Field of Search ..... 400/352, 353, 354, 354.1, 400/354.2, 53; 384/37, 38, 42

[56] References Cited

U.S. PATENT DOCUMENTS

| | | | |
|---|---|---|---|
| 1,536,896 | 5/1925 | Llorens | 400/354 |
| 4,418,371 | 11/1983 | Menden | 400/354 |
| 4,468,144 | 8/1984 | McMahon et al. | 400/354 |
| 4,620,805 | 11/1986 | Belanger | 384/257 |
| 4,756,246 | 7/1988 | Kotasek et al. | 101/93.48 |
| 4,772,899 | 9/1988 | Mamiya et al. | 400/354 |
| 5,033,869 | 7/1991 | Kingston et al. | 384/38 |

FOREIGN PATENT DOCUMENTS

| | | | |
|---|---|---|---|
| 455960 | 10/1936 | United Kingdom | 400/354 |

*Primary Examiner*—Edgar S. Burr
*Assistant Examiner*—Ren Yan

[57] ABSTRACT

A molded plastic printer carriage mountable in the printer on a slider rod uses a pair of spaced sintered bronze bushings and a spring biased preload pad intermediate the bushings which engages the slider rod to compensate for and minimize rocking of the carriage during rapid movement thereof during printing without requiring expensively machined slider rods or close tolerance bushings.

21 Claims, 4 Drawing Sheets

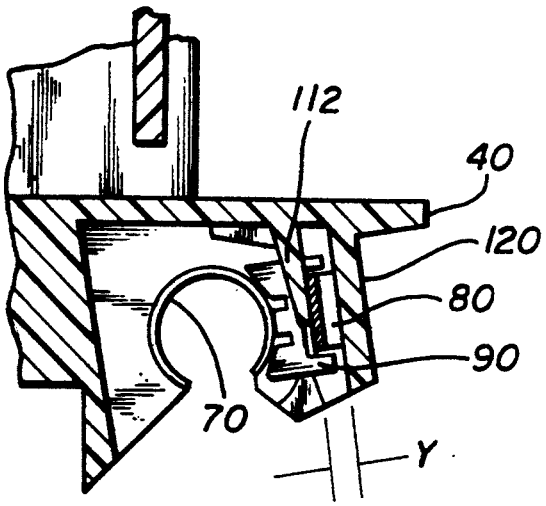
FIG. 5
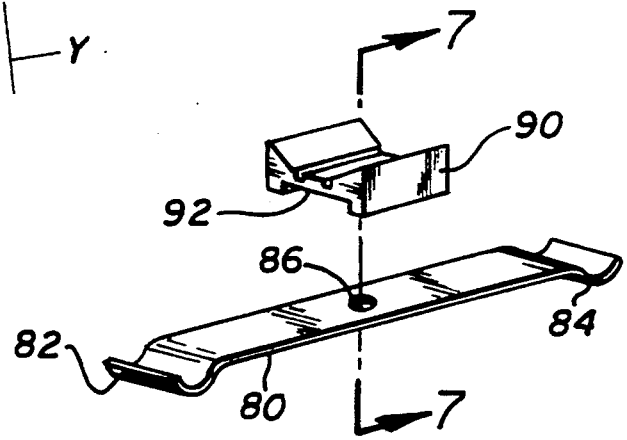
FIG. 6
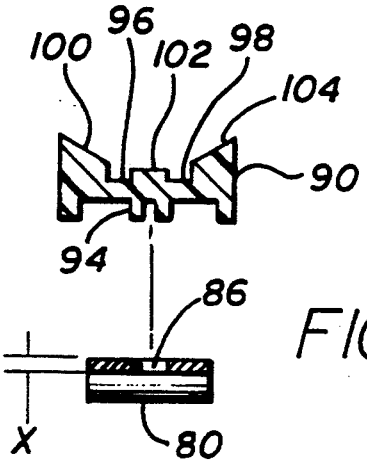
FIG. 7
FIG. 9
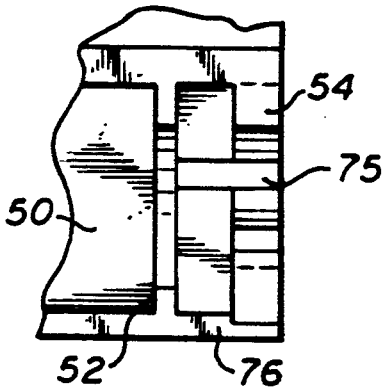
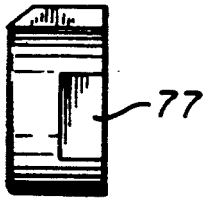
FIG. 8a
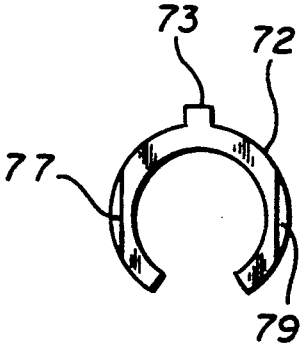
FIG. 8b

SPLIT BUSHING MOUNTING OF A PRINTER CARRIAGE WITH PRE-LOAD

CROSS REFERENCE TO RELATED APPLICATIONS, IF ANY

This application is a Continuation In Part of United States patent application titled PRINTER CARRIAGE BUSHING filed Oct. 23, 1992 by Michael Nguyen under Ser. No. 07/965,480 and assigned to the assignee of the present invention.

BACKGROUND OF THE INVENTION AND PRIOR ART

The present invention relates to a carriage pre-load support and bushing system for a computer driven printer/plotter carriage which slides back and forth transversely of the path of paper travel through the printer/-plotter on at least one smooth support rod which is ordinarily cylindrical.

Carriage bushing systems require high tolerance and low friction and have inherently conflicting design requirements since high tolerance bushing systems require dimensionally stable materials which usually have high coefficients of friction. Conversely, a bushing system which is constructed primarily of lubricous material for reduced friction tends to be dimensionally unstable. Low friction bushings can be manufactured to the required tolerances by secondary processing (i.e., coining) operations with repeated inspections and rejection of bushings that are not manufactured to the correct tolerance. Clearly, such operations materially increase the per part finished cost.

A carriage support system which can be manufactured to and retain close tolerances is therefore required for printer/plotter carriages which must move without impediment at a high rate of speed with frequent reversals in the direction of movement along the slider rods.

SUMMARY OF THE INVENTION

The present invention provides a printer carriage comprising a plurality of print cartridge receptacles and a support system including a slider rod receptacle and a pair of bearings in said receptacle for supporting said carriage for sliding movement on at least one carriage support rod, said support system further comprising a carriage pre-load pad in said receptacle, said pad being engageable with said support rod at a location between said pair of bearings and a spring supported on said carriage for biasing said pad into sliding engagement with said support rod.

BRIEF DESCRIPTION OF THE DRAWING

FIG. 5 is an enlarged cross-section taken at line 5—5 on FIG. 3.

FIG. 6 is an enlarged exploded perspective view of the pre-load spring and pre-load pad seen in FIG. 3.

FIG. 7 is a right hand elevation of the pre-load pad and a cross section through the pre-load spring of FIG. 4.

FIGS. 8*a* and 8*b* respectively comprise an enlarged right hand elevation and an enlarged front elevation of one of the split bushings seen in FIG. 2.

FIG. 9 is an enlarged bottom view of the bushing seat seen in FIG. 2.

DESCRIPTION OF THE PREFERRED EMBODIMENTS

Figure 1:
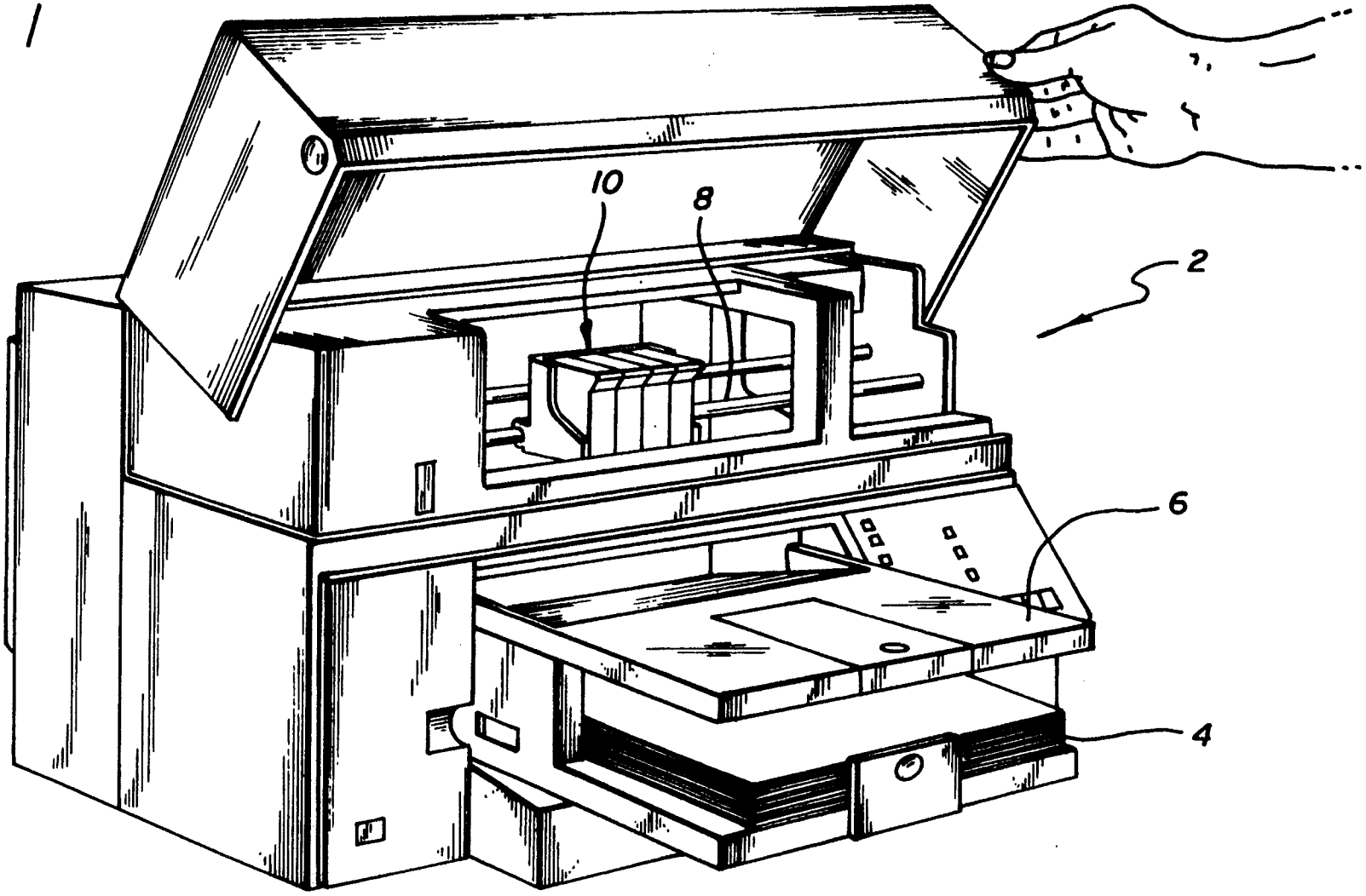
FIG. 1 is a perspective of a desktop printer embodying the teachings of the present invention.

The desktop printer 2 seen in FIG. 1 has vertically spaced paper input and output trays 4, 6 and transversely extending slider rods 8 on which a print head carriage 10 is slideably mounted.

Figure 2:
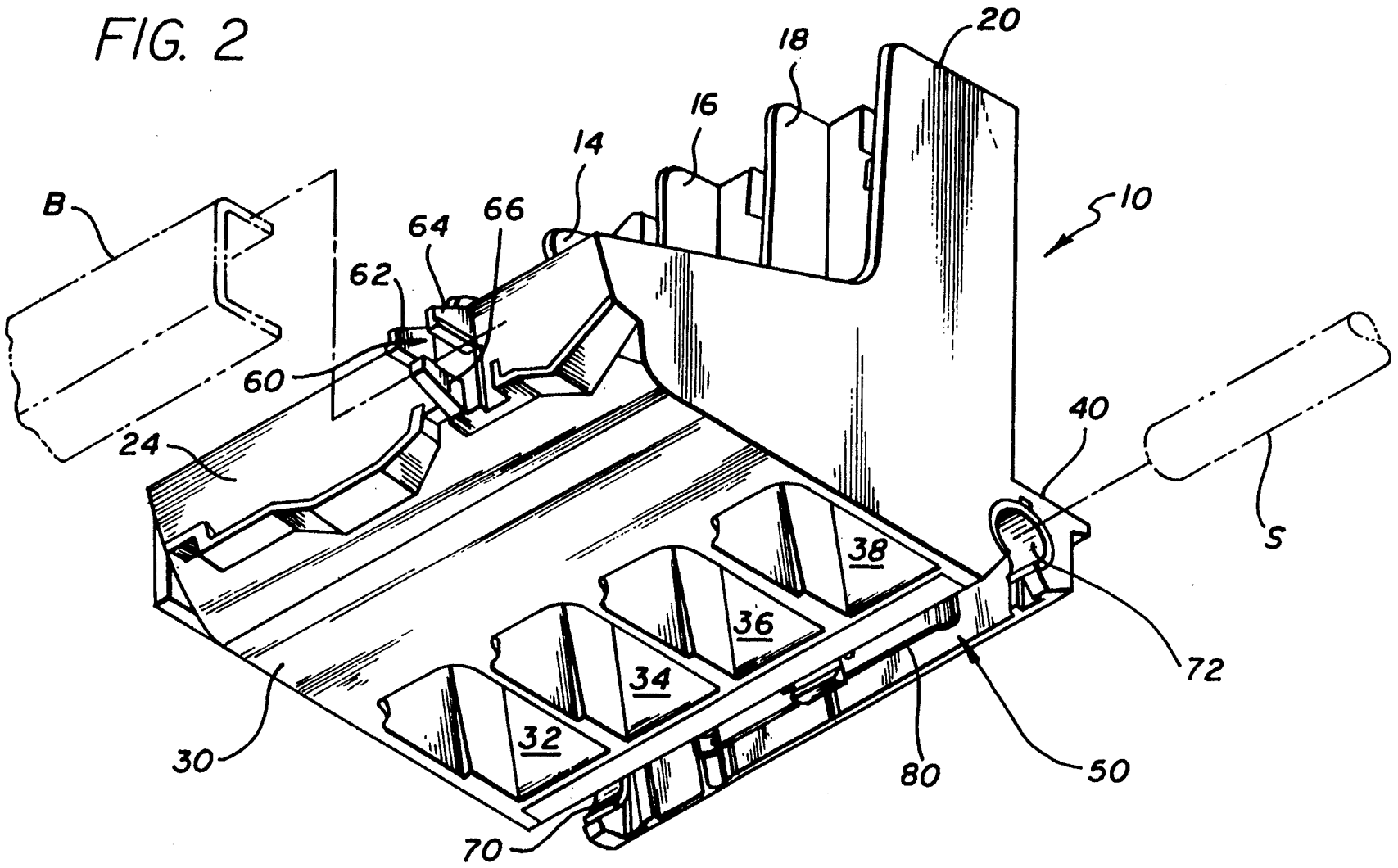
FIG. 2 is a perspective view showing the underside and the right hand side of a printer/plotter carriage mountable for sliding movement on a slider rod shown in phantom.

FIG. 2 shows a perspective view from the bottom front of the printer carriage 10 useful in a computer driven printer/plotter, particularly in an ink jet printer, which uses a plurality of ink cartridges. Ordinarily, four ink cartridges are provided comprising the color black and three primary colors for color ink jet printing. The carriage comprises a molded plastic member comprised of five generally L-shaped parallel spaced plates 12, 14, 16, 18, 20 which define four printer cartridge receptacles therebetween. The cartridge also has an integrally formed front wall 24 as well as a back wall 26 for mounting printed circuits (C) shown in phantom in FIG. 3 which energize the print heads of the respective print cartridges, not shown. The carriage also has an integrally formed bottom wall 30 provided with four apertures 32, 34, 36, 38 which receive the nozzle portions of the print cartridges through which ink is jetted downwardly onto the paper or other medium on which printing is to take place.

The printer carriage 10 also has an integrally formed carriage drive belt support shelf 40 at the lower rear corner thereof and an elongated slider rod receptacle 50 disposed beneath the belt support shelf 40. The carriage 10 supported in the printer and is pulled back and forth by a belt which is connected to the carriage 10 and is supported on the shelf 40 above the slider rod. Carriage 10 moves in a direction transverse to the direction of movement of paper through the printer. Typical prior art carriages are supported on one or more cylindrical slider rods or slider rods and guide tracks whereas the carriage of the present invention is supported at the rear on a single slider rod S shown in phantom in FIG. 2 which extends through the slider rod receptacle 50 and, at the front, on a slider bar B shown in phantom having a horizontally extending flat carriage support surface instead of a cylindrical slider rod. The slider bar is received in a slider bar groove 60 defined between a pair of spaced upper slider bar carriage support bosses 62, 64 and a single lower slider bar guide boss 66 on the front wall 24 of the carriage 10.

A pair of sintered bronze bushings 70, 72 to be described in greater detail below are mounted at opposite ends of the slider rod receptacle 50 in bushing housings 74, 76 in the carriage (FIG. 3) formed during the molding of the carriage 10. Centrally disposed between the bushings 70, 72 in the slider rod receptacle 50 is a carriage pre-load spring 80 which, as best seen in FIGS. 6 and 7, comprises an elongate bar of spring metal having a thickness X of about 0.002 inch and a pair of ends 82, 84 bent toward one side of the bar (the lower side as seen in FIGS. 6 and 7) and a centrally located mounting aperture 86. A carriage pre-load pad 90 has a channel 92 on it's underside dimensioned to receive the spring 80.

Also located on the underside of the pad 90 is a bifurcated connecting post 94 which is received with an interference fit in the spring aperture 86. Due to the bifurcation and the springiness of the material of the pad the post 94 is easily forced into the aperture 86 thereby retaining the pad on the spring without any additional means of affixation.

The upper surface of the pad 90 includes a pair of spaced parallel lubrication grooves 96, 98 which define three spaced wear surfaces 100, 102, 104 which engage the slider rod.

Figure 3:
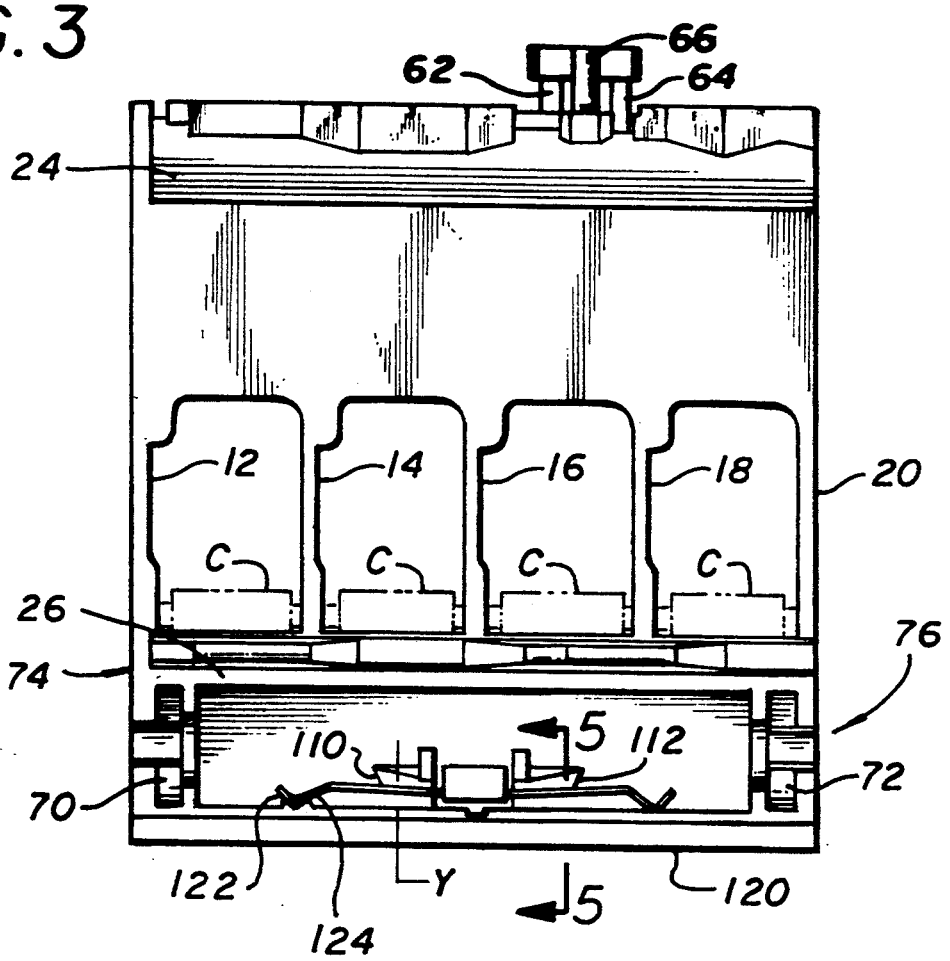
FIG. 3 is a bottom view of the carriage of FIG. 2.
Figure 4:
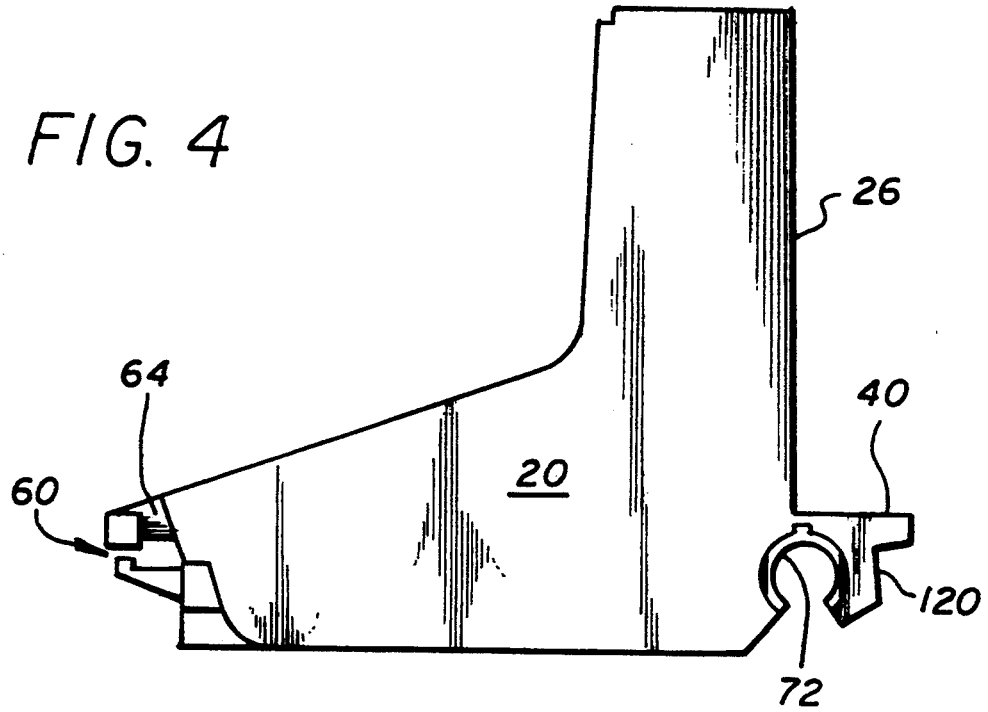
FIG. 4 is a right side elevation view of the carriage of FIG. 2.

As best seen in FIGS. 3 and 5, the carriage 10 is molded with a pair of spaced wings 110, 112 centrally located between the bushings 70, 72 in the rod receptacle 50 which define a clearance space therebetween for receiving the pre-load spring and pad which is retained therein by a spring fit. The wings 110, 112 are integrally formed on the underside of the belt support shelf 40 and are spaced from a vertically extending rear wall 120 beneath the support shelf a distance Y (FIG. 5) which permits movement of the pad against the bias of the spring a distance (Y-X) in a direction transversely to the slider rod. The spaced wings 110, 112 engage the spring 80 on opposite sides of the pre-load pad 90. The carriage also has a pair of integrally formed spaced parallel bars 122, 124 which extend from the rear wall 120 into the slider rod receptacle 50 in a direction transverse to the axial direction of the slider rod to restrain axial movement of the spring 8 by confining one (82) of the bent ends 82 or 84 between the integrally formed bars 122, 124.

The bushings 70, 72 and bushing housings 74, 76 are best described with reference to FIGS. 8 and 9. Each bushing 70, 72 comprises a sintered bronze C-shaped open section provided with radially extending projections which abut corresponding surfaces of the plastic carriage bushing housings 74, 76 to prevent axial and rotational movement of the bushings with respect to the carriage. The radially extending projections are defined by a key 73 on the bushing and a key slot 75 in the housing 76 which engage each other to prevent rotational movement of the bushing in the housing. Each bushing also has flat surfaces 77, 79 on diametrically opposite exterior sides thereof which extend for an axial length of approximately one-half the total axial length of the bushing 70, 72. These flat surfaces 77, 79 define radially extending surfaces on the bushing near the axial center thereof. The left end of the bushing as seen in FIG. 8*a* defines another radially extending surface on the bushing. These radially extending bushing surfaces closely abut and engage radially extending surfaces on spaced inner and outer webs 52, 54 molded in the carriage 10 which, with the annular inner side wall of the slider wall receptacle 50, define the bushing housings 74, 76. The abutting radially extending surfaces of the bushings and housings prevent axial movement of the bushings 70, 72 in the housings 74, 76.

In any printer carriage which is subject to repeated back and forth movement on the slider rod or rods, it is essential that misalignment or skewing which has a drastically adverse effect on print quality be avoided or minimized. This objective ordinarily is accomplished by the use of expensive large carefully machined slider rods and bearings but is accomplished in the present carriage by a unique combination of features which results in lower overall cost. These features include, but are not necessary limited to, the following:

(1) The use of open C-shaped bearings which permit the use of smaller diameter slider rods due to the fact that the slider rods can be supported at locations intermediate their ends without interference with the sliding motion of the carriage;

(2) Positioning of the slider rod receptacle substantially beneath a carriage drive belt support shelf so that the carriage drive belt is physically close to and not horizontally offset from the centerline of the slider rod;

(3) Positioning of the printhead nozzles close to a single straight slider rod so that a less expensive and consequently slightly less straight slider bar instead of a slider rod can be used near the front of the carriage;

(4) The use of a carriage pre-load pad positioned intermediate spaced bronze bearings so that the carriage is engaged with the slider rod with a predeterminable and controllable degree of force which is low enough to permit free sliding motion yet high enough to reduce the amount of undesired skewing of the carriage in the sintered bushings.

Preferably, the pre-load pad 90 is constructed of a plastic material which is hard but lubricous. A preferred combination is Acetyl plastic and Teflon. The oil impregnated sintered bronze bushings 70, 72 are less expensive than machined bushings and relax the high requirements on rod surface finish thus reducing final product cost.

Persons skilled in the art will readily appreciate that various modifications can be made from the preferred embodiment thus the scope of protection is intended to be defined only by the limitations of the appended claims.

We claim:

1. A printer carriage comprising:

a plurality of print cartridge receptacles;

a support system including a slider rod receptacle;

a pair of bearings in said slider rod receptacle for supporting the carriage for sliding movement on at least one carriage support rod;

said support system further comprising a carriage pre-load pad in said slider rod receptacle, said pad centrally positioned between said bearings and engageable with said support rod at a location between said pair of bearings;

a spring supported on the carriage for biasing said pad into sliding engagement with said support rod; and wherein said spring comprises an elongate flat bar having a pair of ends bent toward one side of said bar, and said pad is mounted on the side of said bar opposite said bends and intermediate said ends.

2. The carriage of claim 1, further comprising spring retainers on said carriage, at least one of said retainers preventing movement of said pad beyond a predetermined limit in a direction away from the side of said bar having said bent ends.

3. The carriage of claim 2, comprising a pair of said retainers for preventing movement of said pad beyond a predetermined limit in a direction away from the side of said bar having said bent ends, said retainers being engageable with said spring to retain said spring and pad during assembly.

4. The carriage of claim 3, further comprising a spring retainer on said carriage restraining axial movement of one of said bent ends of said spring.

5. The carriage of claim 4, wherein said retainer which restrains axial movement of said spring comprises a pair of spaced parallel bars on said carriage confining one of said bent spring ends therebetween.

6. The carriage of claim 4, wherein said bearings are positioned at opposite ends of said slider rod receptacle and said slider rod receptacle is located on said carriage proximate a lower back edge of said carriage.

7. The carriage of claim 6, further comprising a carriage drive belt support shelf on said carriage positioned laterally rearwardly of said print cartridge receptacles, said slider rod receptacle being located beneath said shelf.

8. The carriage of claim 1, wherein each of said bearings comprise a bushing housing in said slider rod receptacle and a bushing in each housing, said housings and bushings having abutting walls for preventing axial and rotational movement of said bushings with respect to said carriage.

9. The carriage of claim 8, wherein said bushings are split bushings each having at least one axially extending flat surface defining a wall which contacts said housing to prevent axial movement of said bushing.

10. The carriage of claim 9, wherein said bushings each have a pair of diametrically opposite flat surfaces thereon.

11. A printer carriage comprising:

a plurality of print cartridge receptacles;

a support system including a slider rod receptacle;

a pair of bearings in said slider rod receptacle for supporting the carriage for sliding movement on at least one carriage support rod;

said support system further comprising a carriage pre-load pad in said slider rod receptacle, said pad centrally positioned between said bearings and engageable with said support rod at a location between said pair of bearings:

a spring supported on the carriage for biasing said pad into sliding engagement with said support rod; and wherein each of said bearings comprise a busing housing in said slider rod receptacle and a split bushing in each housing, said housings and bushings having abutting walls for preventing axial and rotational movement of said bushings with respect to said carriage, with each split busing having a pair of diametrically opposite flat surfaces thereon extending axially to define a wall which contacts said housing to prevent axial movement of said bushing, said flat surfaces extending less than the full axial length of said bushings.

12. The carriage of claim 11, wherein said housing walls which abut said bushing walls comprise a pair of spaced webs.

13. The carriage of claim 12, wherein said bushings are oil impregnated sintered bronze.

14. The carriage of claim 13, wherein said pre-load pad is centrally positioned between said bearings.

15. The carriage of claim 14, wherein said spring comprises an elongate flat bar having a pair of ends bent toward one side of said bar and said pad is mounted on the side of said bar opposite said bends and intermediate said ends.

16. The carriage of claim 15, further comprising spring retainer wings on said carriage, at least one of said wings preventing movement of said pad beyond a predetermined limit in a direction away from the side of said bar having said bents.

17. The carriage of claim 16, comprising a pair of said retainers for preventing movement of said pad beyond a predetermined limit in a direction away from the side of said bar having said bent ends, said retainers being engageable with said spring to retain said spring and said pad during assembly.

18. The carriage of claim 17, further comprising a spring retainer on said carriage restraining axial movement of one of said bent ends of said spring.

19. The carriage of claim 18, wherein said retainer which restrains axial movement of said spring comprises a pair of spaced parallel bars on said carriage confining one of said bent spring ends therebetween.

20. The carriage of claim 18, wherein said bearings are positioned at opposite ends of said slider rod receptacle and said slider rod receptacle is located on said carriage proximate a lower back edge of said carriage.

21. The carriage of claim 20, further comprising a carriage drive belt support shelf on said carriage positioned laterally rearwardly of said print cartridge receptacles, said slider rod receptacle being located beneath said shelf.

* * * * *